US011927388B2

(12) United States Patent
Camacho et al.

(10) Patent No.: US 11,927,388 B2
(45) Date of Patent: Mar. 12, 2024

(54) REVERSIBLE DRAWER ASSEMBLY

(71) Applicant: Electrolux Home Products, Inc., Charlotte, NC (US)

(72) Inventors: Cristhian Camilo Serrano Camacho, Charlotte, NC (US); Max Henrique Barth, Curitiba (BR)

(73) Assignee: Electrolux Home Products, Inc., Charlotte, NC (US)

( * ) Notice: Subject to any disclaimer, the term of this patent is extended or adjusted under 35 U.S.C. 154(b) by 21 days.

(21) Appl. No.: 17/380,242

(22) Filed: Jul. 20, 2021

(65) Prior Publication Data

US 2023/0024634 A1 Jan. 26, 2023

(51) Int. Cl.
*F25D 25/02* (2006.01)
*F25D 17/04* (2006.01)
*F25D 23/02* (2006.01)

(52) U.S. Cl.
CPC ..... *F25D 25/025* (2013.01); *F25D 17/042* (2013.01); *F25D 2325/021* (2013.01)

(58) Field of Classification Search
CPC . F25D 25/025; F25D 17/042; F25D 2325/021
See application file for complete search history.

(56) References Cited

U.S. PATENT DOCUMENTS 8,181,807 B2 * 5/2012 Hay ..... B65D 90/0033 220/826
8,651,598 B2 * 2/2014 Go ..... F25D 25/005 312/404
8,820,864 B2 * 9/2014 Crookshanks ..... F25D 25/022 312/213
9,241,568 B2 * 1/2016 Crookshanks ..... A47B 95/02
9,243,840 B1 1/2016 Kelly
9,255,729 B2 2/2016 Rindlisbach et al.
9,816,746 B1 11/2017 Haney et al.
10,197,327 B2 2/2019 Kim
10,240,857 B2 3/2019 Yu et al.
10,575,638 B2 3/2020 Wantland et al.
10,845,112 B2 11/2020 Placke et al.
11,589,687 B2 * 2/2023 Park ..... F25D 23/02
(Continued)

FOREIGN PATENT DOCUMENTS

CA 2838690 A1 * 7/2014 ..... A47B 88/90
CN 108469146 8/2018
(Continued)

OTHER PUBLICATIONS

International Search Report and Written Opinion mailed in PCT/US2022/036204, dated Sep. 29, 2022, 16 pages.

*Primary Examiner* — Kimberley S Wright
(74) *Attorney, Agent, or Firm* — Pearne & Gordon LLP

(57) ABSTRACT

A refrigerator appliance includes a storage compartment having a storage drawer assembly disposed therein. The storage drawer assembly includes a carrier drawer, a lid, and a bin that may be reversibly mounted in the carrier drawer in either a first orientation or in a second orientation. The bin defines a storage space for receiving food items. The bin includes a sealing wall that encloses the storage space in the first orientation. The bin defines an access opening that grants access to the storage space in the second orientation.

21 Claims, 14 Drawing Sheets

(56) References Cited

U.S. PATENT DOCUMENTS

| | | | | |
|---|---|---|---|---|
| 2006/0049731 | A1* | 3/2006 | Choi | A47B 88/49 312/330.1 |
| 2010/0231105 | A1 | 9/2010 | Latif | |
| 2010/0307186 | A1 | 12/2010 | Kwon et al. | |
| 2011/0259036 | A1 | 10/2011 | Lim et al. | |
| 2013/0056477 | A1* | 3/2013 | Go | F25D 25/005 220/592.02 |
| 2014/0312758 | A1 | 10/2014 | Gossens et al. | |

FOREIGN PATENT DOCUMENTS

| | | | | | |
|---|---|---|---|---|---|
| DE | 102012221494 | | | 5/2014 | |
| DE | 102019100779 | | | 7/2020 | |
| DE | 102019107120 | | | 9/2020 | |
| EP | 2381195 | | | 10/2011 | |
| GB | 680407 | | | 10/1952 | |
| GB | 2519305 | A | * | 4/2015 | F25D 23/087 |
| JP | 86096578 | | | 7/1985 | |
| JP | 11304354 | A | * | 11/1999 | F25D 25/025 |
| KR | 100885729 | | | 2/2009 | |
| KR | 20100028783 | | | 3/2010 | |
| KR | 101076507 | | | 10/2011 | |
| KR | 101195252 | | | 10/2012 | |
| KR | 101892746 | | | 10/2012 | |
| WO | WO2002040931 | | | 5/2002 | |
| WO | WO2003060403 | | | 7/2003 | |
| WO | WO2011138114 | | | 11/2011 | |
| WO | WO2012010443 | | | 1/2012 | |
| WO | 2012106316 | | | 8/2012 | |
| WO | WO2019141049 | | | 7/2019 | |
| WO | WO-2019205816 | A1 | * | 10/2019 | A47B 88/963 |

* cited by examiner

REVERSIBLE DRAWER ASSEMBLY

FIELD OF THE INVENTION

This application relates generally to a refrigerator appliance including a storage assembly, and more particularly, to a refrigerator appliance including a storage drawer assembly having a carrier drawer and a bin that may be reversibly mounted in the carrier drawer in either a first or a second orientation.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventional refrigerator appliances also generally include one or more storage drawer assemblies that that are isolated from the main storage compartment for storing fresh produce (e.g., lettuce, fruits, etc.) or other food products (e.g., fresh meats, dairy products, raw fish, etc.) therein. Such drawer assemblies are generally configured to perform a single function of creating a suitable environment for prolonging the edible life of the food products stored therein. For example, many drawer assemblies are configured to function as crisper drawers that are operable to optimize the humidity level therein, for example, when storing fruits and vegetables that are susceptible to spoilage when exposed to dry air. Yet, in other examples, some drawer assemblies are configured to function as chiller compartments that are operable at a temperature setting corresponding to the type of food product stored therein e.g., raw fish or fresh meat. However, many consumers desire to utilize such drawer assemblies for other uses, such as storing poultry, dairy products, snacks, and beverage containers.

Additionally, many consumers forget about food items stored in the drawer assembly since, generally, viewing the internal contents thereof requires extending a drawer thereof to a fully extended position. This lends itself to undesirable waste since forgotten food items tend to rot and/or spoil, thereby becoming unsuitable for human ingestion. Moreover, such drawer assemblies are generally more inaccessible in comparison to other refrigerator storage accessories (e.g., open shelves) since consumers desiring to retrieve food items stored therein must extend a drawer thereof to a fully extended position. Thus, there exists a need to provide a storage solution that is more accessible and versatile for storing a variety of food items inside of the drawer assembly.

BRIEF SUMMARY OF THE INVENTION

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with one aspect, there is provided a storage drawer assembly including a carrier drawer that is configured to be extended or retracted relative to a storage compartment, and a bin that is reversibly mounted in the carrier drawer. The bin defines a storage space for receiving food items and is configured to be mounted in the carrier drawer in either a first orientation or a second orientation. The bin is configured to at least partially enclose the storage space in the first orientation, and grant access to the storage space in the second orientation.

In accordance with another aspect, there is provided a crisper assembly including a plurality of carrier drawers, wherein each carrier drawer is configured to be independently extended or retracted relative to a storage compartment. The crisper assembly also includes a plurality of bins that are each reversibly mounted in a selected one of the carrier drawers, respectively. Each bin defines a storage space of the crisper assembly and is configured to be mounted in a respective carrier drawer in either a first orientation or a second orientation. Each bin also at least partially encloses the respective storage space in the first orientation, and grants access to the respective storage space in the second orientation. A lid is disposed above the carrier drawers and is configured to cover the storage spaces of the crisper assembly when the bins are mounted in the first orientation.

In accordance with yet another aspect, a refrigerator appliance includes a refrigerator storage compartment and a plurality of carrier drawers. Each carrier drawer is configured to be independently extended or retracted relative to the storage compartment. The refrigerator appliance also includes a plurality of bins that are each reversibly mounted in a selected one of the respective drawers. Each bin defines a storage space of the storage compartment and is configured to be mounted in the respective carrier drawer in either a first orientation or a second orientation. Each bin also at least partially encloses the respective storage space in the first orientation, and grants access to the respective storage space in the second orientation. A lid is disposed above the carrier drawers and includes a gasket and a downwardly protruding wall. The gasket is configured to sealingly engage the bins when the bins are in the first orientation, and the downwardly protruding wall is configured to cooperate with the carrier drawers when the carrier drawers are retracted relative to the storage compartment for enclosing the respective storage spaces of the storage compartment. The refrigerator appliance also includes a central support that is configured to secure the lid to the storage compartment.

It is to be understood that both the foregoing general description and the following detailed description present embodiments of the present disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure and together with the description serve to explain the principles and operations thereof.

BRIEF DESCRIPTION OF THE DRAWINGS

These and other features, aspects and advantages of the present disclosure can be further understood when read with reference to the accompanying drawings.

DESCRIPTION OF EXAMPLE EMBODIMENTS

Figure 1:
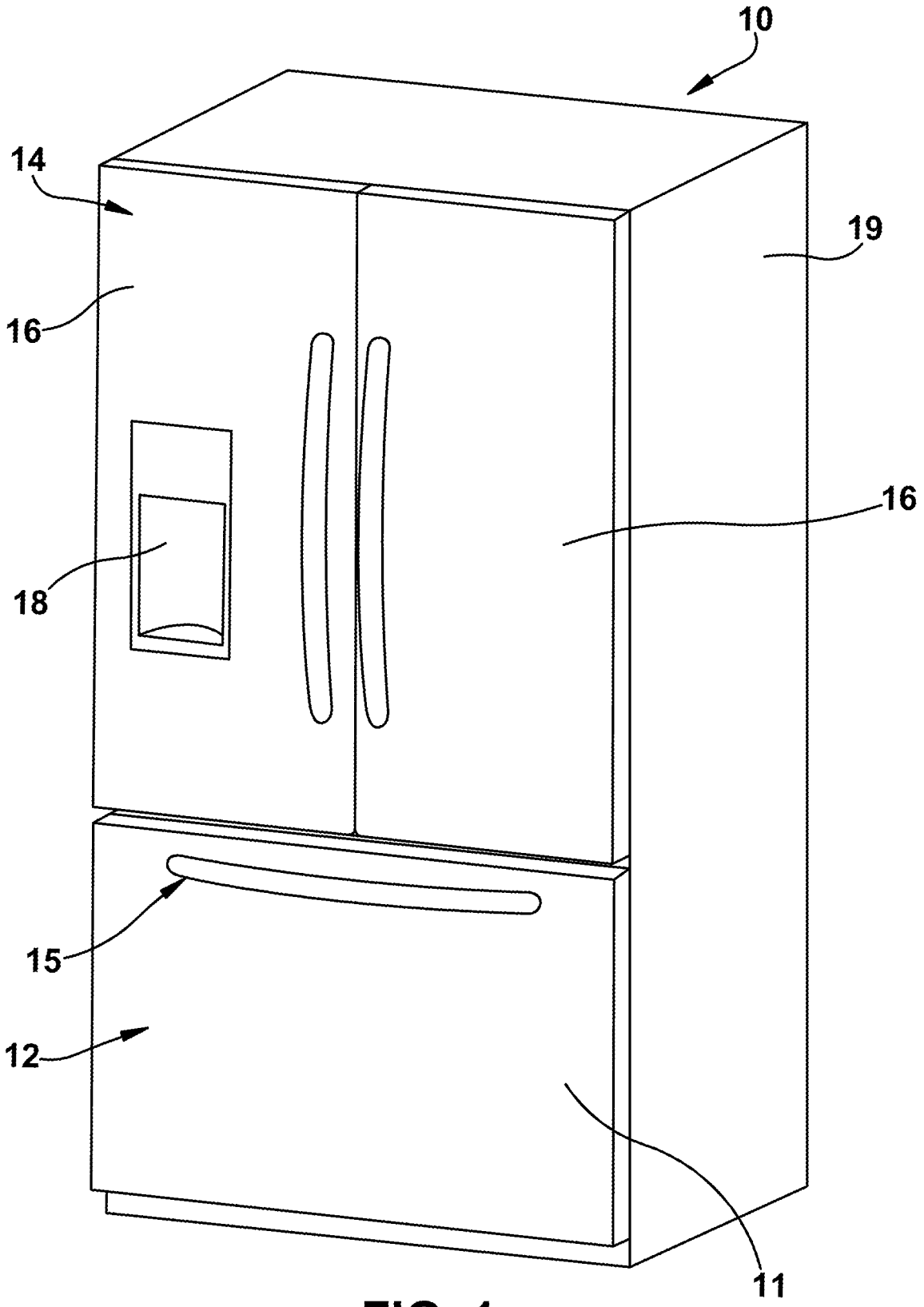
FIG. 1 is a front perspective view of a household French Door Bottom Mount refrigerator wherein doors of the refrigerator are in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food storage compartment 14 disposed vertically above a freezer storage compartment 12. However, the refrigerator 10 can have any desired configuration including at least one of a fresh food storage compartment 14 and/or a freezer storage compartment 12, such as a top mount refrigerator (freezer disposed above the fresh food compartment), a side-by-side refrigerator (fresh food compartment is laterally next to the freezer compartment), a standalone refrigerator or freezer having a single main compartment, etc.

Figure 2:
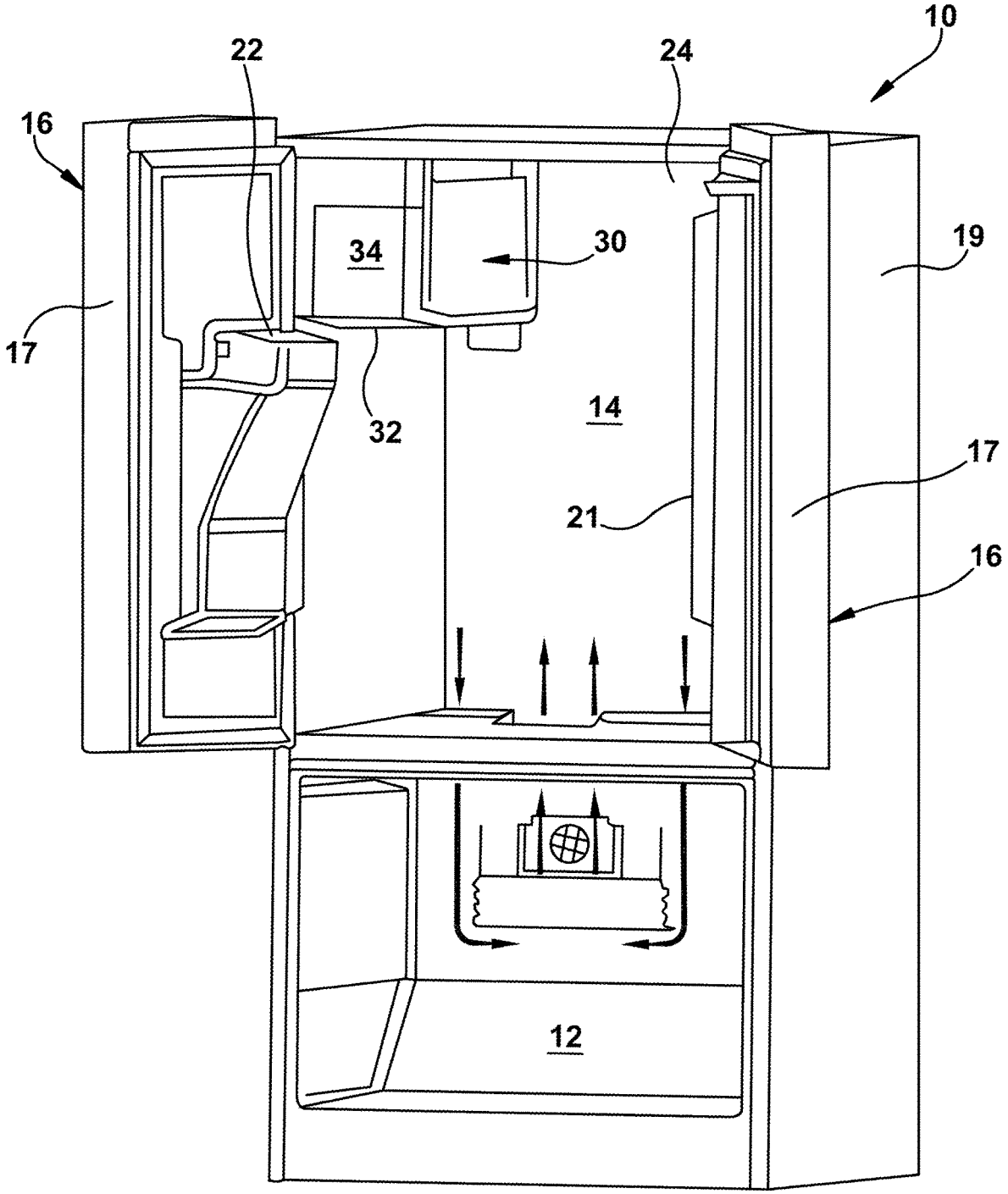
FIG. 2 is a front perspective view of the refrigerator of FIG. 1 showing the doors in an opened position and an interior of a fresh food compartment.

One or more doors 16 shown in FIG. 1 are pivotally coupled to a cabinet 19 of the refrigerator 10 to restrict and grant access to the fresh food storage compartment 14. The door 16 can include a single door that spans the entire lateral distance across the entrance to the fresh food storage compartment 14, or can include a pair of French-type doors 16 as shown in FIG. 1 that collectively span the entire lateral distance of the entrance to the fresh food storage compartment 14 to enclose the fresh food storage compartment 14. For the latter configuration, a center flip mullion 21 (FIG. 2) is pivotally coupled to at least one of the doors 16 to establish a surface against which a seal provided to the other one of the doors 16 can seal the entrance to the fresh food storage compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food storage compartment 14.

A dispenser 18 (FIG. 1) for dispensing at least ice pieces, and optionally water, can be provided on an exterior of one of the doors 16 that restricts access to the fresh food storage compartment 14. The dispenser 18 includes an actuator (e.g., lever, switch, proximity sensor, etc.) to cause frozen ice pieces to be dispensed from an ice bin 34 (FIG. 2) of an ice maker 30 disposed within the fresh food storage compartment 14. Ice pieces from the ice bin 34 can exit the ice bin 34 through an aperture 32 and be delivered to the dispenser 18 via an ice chute 22 (FIG. 2), which extends at least partially through the door 16 between the dispenser 18 and the ice bin 34.

Referring to FIG. 1, the freezer storage compartment 12 is arranged vertically beneath the fresh food storage compartment 14. A drawer assembly (not shown) including one or more freezer baskets (not shown) can be withdrawn from the freezer storage compartment 12 to grant a user access to food items stored in the freezer storage compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer storage compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer storage compartment 12 is used to freeze and/or maintain articles of food stored in the freezer storage compartment 12 in a frozen condition. For this purpose, the freezer storage compartment 12 is in thermal communication with a freezer evaporator (not shown) that removes thermal energy from the freezer storage compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food storage compartment 14. The fresh food storage compartment 14 is located in the upper portion of the refrigerator 10 in this example and serves to minimize spoiling of articles of food stored therein. The fresh food storage compartment 14 accomplishes this by maintaining the temperature in the fresh food storage compartment 14 at a cool temperature that is typically above 0° C., so as not to freeze the articles of food in the fresh food storage compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food storage compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food storage compartment 14 independent of the freezer storage compartment 12. According to an embodiment, the temperature in the fresh food storage compartment 14 can be maintained at a cool temperature within a close tolerance of a range between 0° C. and 4.5° C., including any subranges and any individual temperatures falling with that range. For example, other embodiments can optionally maintain the cool temperature within the fresh food storage compartment 14 within a reasonably close tolerance of a temperature between 0.25° C. and 4° C.

Figure 3:
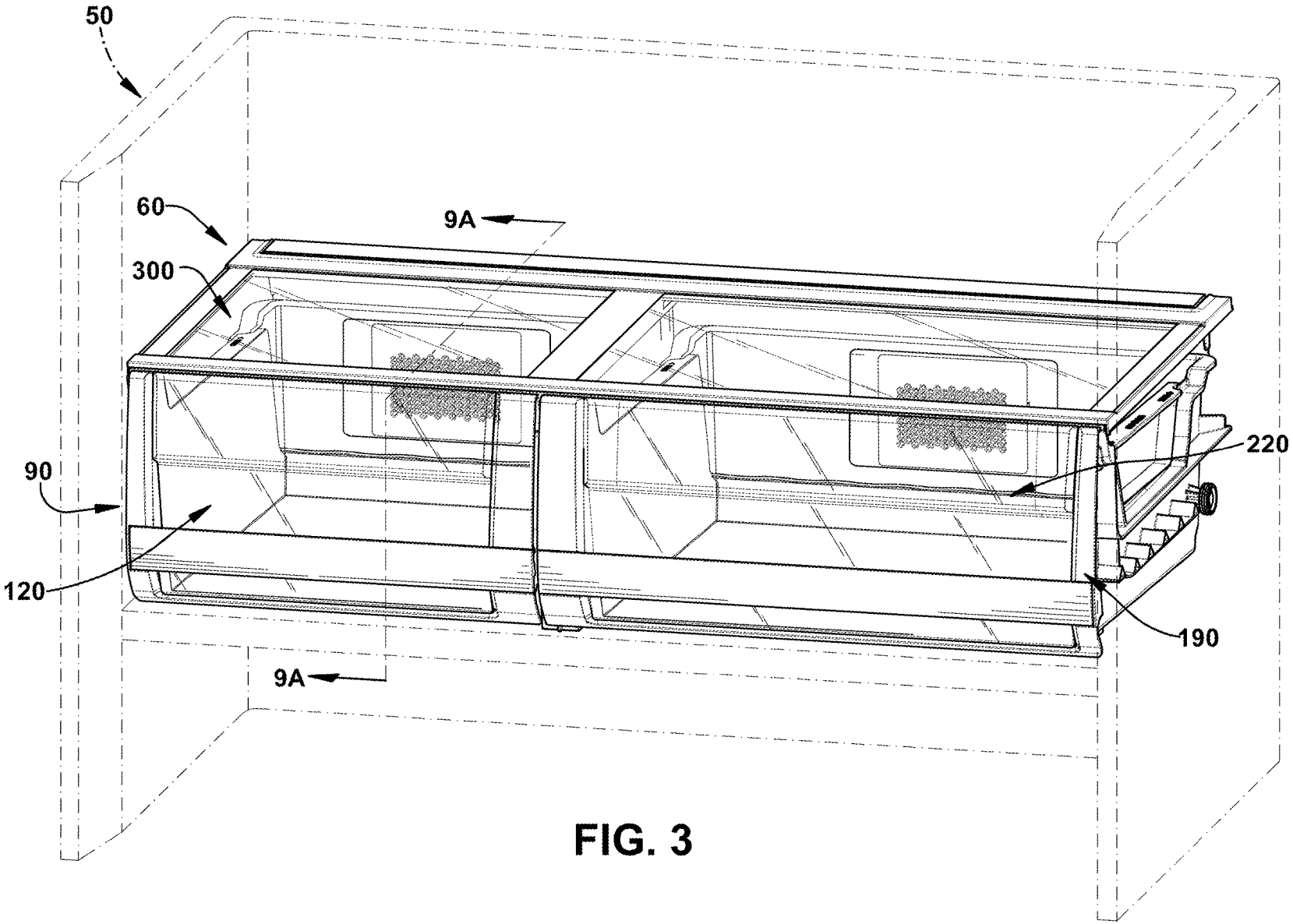
FIG. 3 is a front perspective view of an example storage drawer assembly shown in relation to a storage compartment according to another embodiment, wherein bins of the storage drawer assembly are shown in a first orientation.

Turning now to FIG. 3, a storage compartment 50 is shown with an example storage drawer assembly 60 according to a first embodiment. In general, the storage drawer assemblies described herein provide consumers a more accessible and versatile storage solution for storing a variety of food items.

Figure 4:
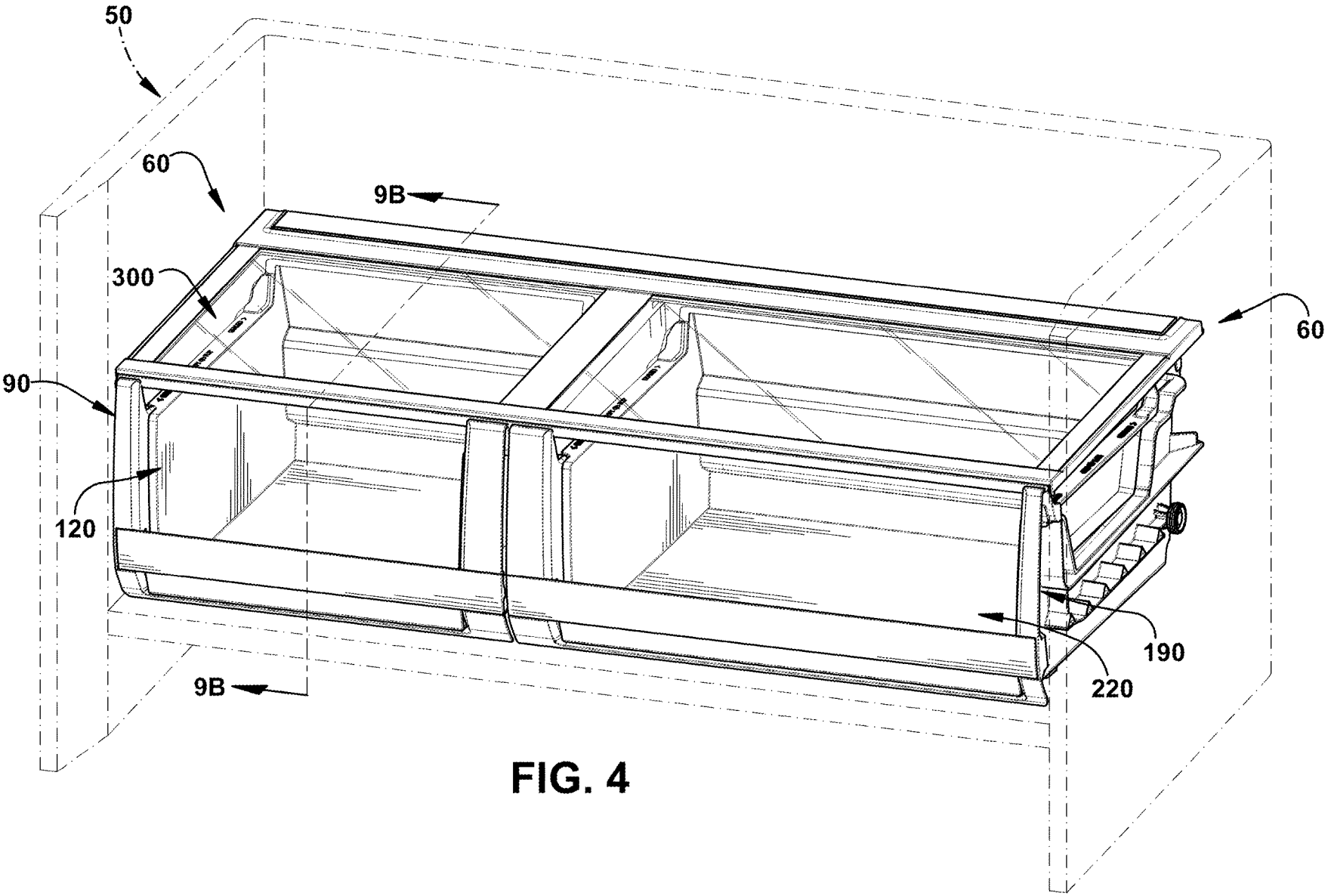
FIG. 4 is a front perspective view of the example storage drawer assembly of FIG. 3 wherein bins of the storage drawer assembly are shown in a second orientation.

In the illustrated embodiment, the storage drawer assembly 60, in general, includes a pair of carrier drawers 90, 190, a pair of bins 120, 220, and a lid 300. Each of the bins 120, 220 may be reversibly mounted in the carrier drawers 90, 190, respectively, in either a first orientation (FIG. 3) or a second orientation (FIG. 4), as described in detail below. In the shown example, the carrier drawers 90, 190 are illustrated in an asymmetrical arrangement, whereby each carrier drawer 90, 190 has a different width. In some examples, it is contemplated that the carrier drawers 90, 190 may have a symmetrical arrangement with the same width, whereby the bins 120, 220 can be interchangeably received by either carrier drawer 90, 190. Additionally, although the illustrated examples herein include two bins arranged next to each other, it is contemplated that only one, or more than two, bins can be utilized with the various inventions described herein. Moreover, multiple bins can be located variously inside the refrigerator and do not necessarily have to be arranged next to each other.

Figure 5:
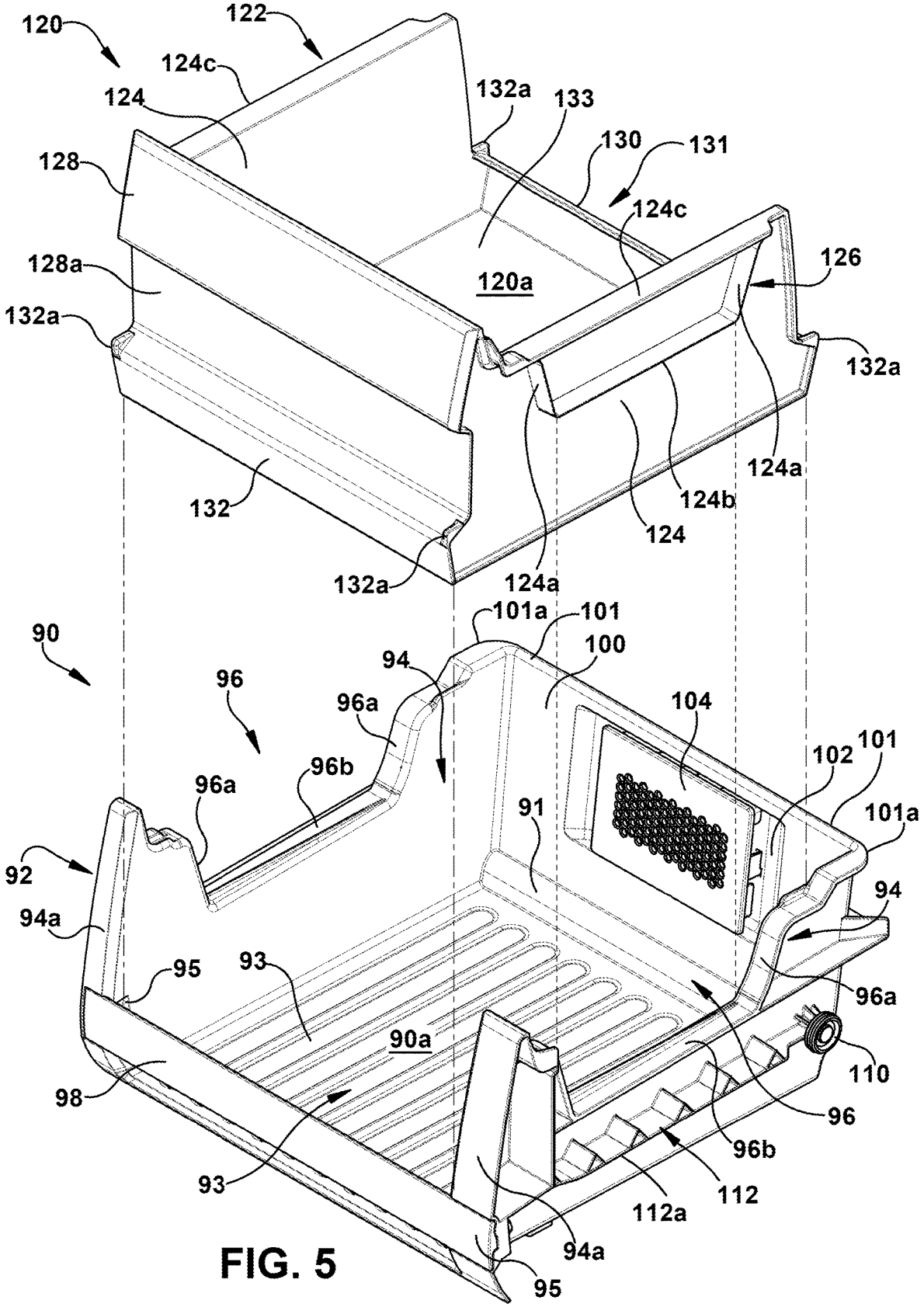
FIG. 5 is a perspective view of a carrier drawer shown in relation to a bin of the storage drawer assembly of FIG. 3 wherein the bin is positioned above the drawer in a first orientation.

Referring to FIG. 5, an example of the carrier drawer 90 is shown in relation to the bin 120, wherein the bin 120 is positioned above the carrier drawer 90 in the first orientation. Since the following description substantially applies to the other carrier drawer 190, a full description therefor has been omitted for brevity, except for the differences noted below.

The carrier drawer 90 is preferably made of a plastic material of suitable strength (e.g., ABS, polypropylene, polystyrene, and the like). In the illustrated embodiment, the carrier drawer 90 is presented as being made of an opaque plastic material. In alternative embodiments, the carrier drawer 90 may comprise a transparent, tinted, or translucent plastic material. The carrier drawer 90 includes a bottom wall 90*a* and an upwardly extending wall 92 formed about at least a portion of the perimeter of the bottom wall 90*a*. In particular, the upwardly extending wall 92 includes a rear wall 100 and opposing side walls 94 that together define a front access opening 93 therebetween. A front surface 94*a* of each side wall 94 defines a recess 95 that is shaped and dimensioned to accommodate opposing ends of a handle 98 that is operable to extend or retract the carrier drawer 90 relative to the storage compartment 50 (FIG. 3).

A projection or curb 91 is formed on the rear wall 100 of the carrier drawer 90, for example at a junction of the bottom wall 90*a* and the rear wall 100. The curb 91 is configured to abut an exterior surface of the bin 120 when the bin 120 is inserted in the carrier drawer 90, as described in detail below.

Contoured, substantially U-shaped recesses 96 may be formed into upper portions of the side walls 94, respectively. Each contoured recess 96 is shaped and dimensioned to cooperate with a mating guide 126 formed on a respective side wall 124 of the bin 120 to facilitate placing the bin 120 into the carrier drawer 90, as discussed in detail below. Additionally, each contoured recess 96 also defines an access opening for a hand, for example, when it is desired to grip the bin 120 (via flanges or tabs 124*c* extending outwardly therefrom) to remove the bin 120 from the carrier drawer 90. Moreover, in some examples, the recesses 96 also define openings for the passage of light such that the inner contents of the bin 120 may be illuminated and made more visible to a user.

Still referring to FIG. 5, the side walls 94 of the carrier drawer 90 may include rollers 110 removably attached to rear portions thereof. The rollers 110 are configured to roll along or within recessed tracks 410 (See, e.g., FIG. 10) located on opposite sides of the carrier drawer 90, respectively, to facilitate the extension or retraction of the carrier drawer 90 relative to the storage compartment 50. Elongated, guides 112 may be formed depending from the respective side walls 94 of the carrier drawer 90. Each guide 112 includes a lower surface 112*a* that defines a roller surface for conveying a stationary roller 412 (See, e.g., FIG. 10) located on a respective side of the carrier drawer 90. In this manner, the rollers 110 of the carrier drawer 90 and the stationary rollers 412 (FIG. 10) together provide a reduced friction interface between the carrier drawer 90 and the storage compartment 50 such that the carrier drawer 90 may be easily extended or retracted relative thereto. It is contemplated that the carrier drawer 90 may include various other linear motion supports, such as linear ball bearing slides, various other arrangements of wheels, etc.

Optionally, a substantially rectangular-shaped depression 102 may be formed in the rear wall 100 of the carrier drawer 90. In particular, the depression 102 is adapted to removably receive and retain at least one filter cartridge 104 for treating the environment inside of a sealed or enclosed storage space 315 (FIG. 9A) of the storage drawer assembly 60 that is defined by the bin 120 (in the first orientation), the carrier drawer 90 (in a retracted state), the lid 300, a respective storage compartment wall 50*a* (FIG. 3), and a center support 400 (FIG. 10) of the storage drawer assembly 60, as discussed in detail below. In various non-limiting examples, the cartridge 104 could include any or all of an ethylene absorber cartridge; an air filter cartridge; a deodorizer cartridge; an antioxidant cartridge; a humidity control cartridge; etc. In some examples, it is contemplated that the depression 102 may be formed in another wall of the carrier drawer 90 for retaining the cartridge 104 thereto, e.g., a side wall, etc.

Figure 6:
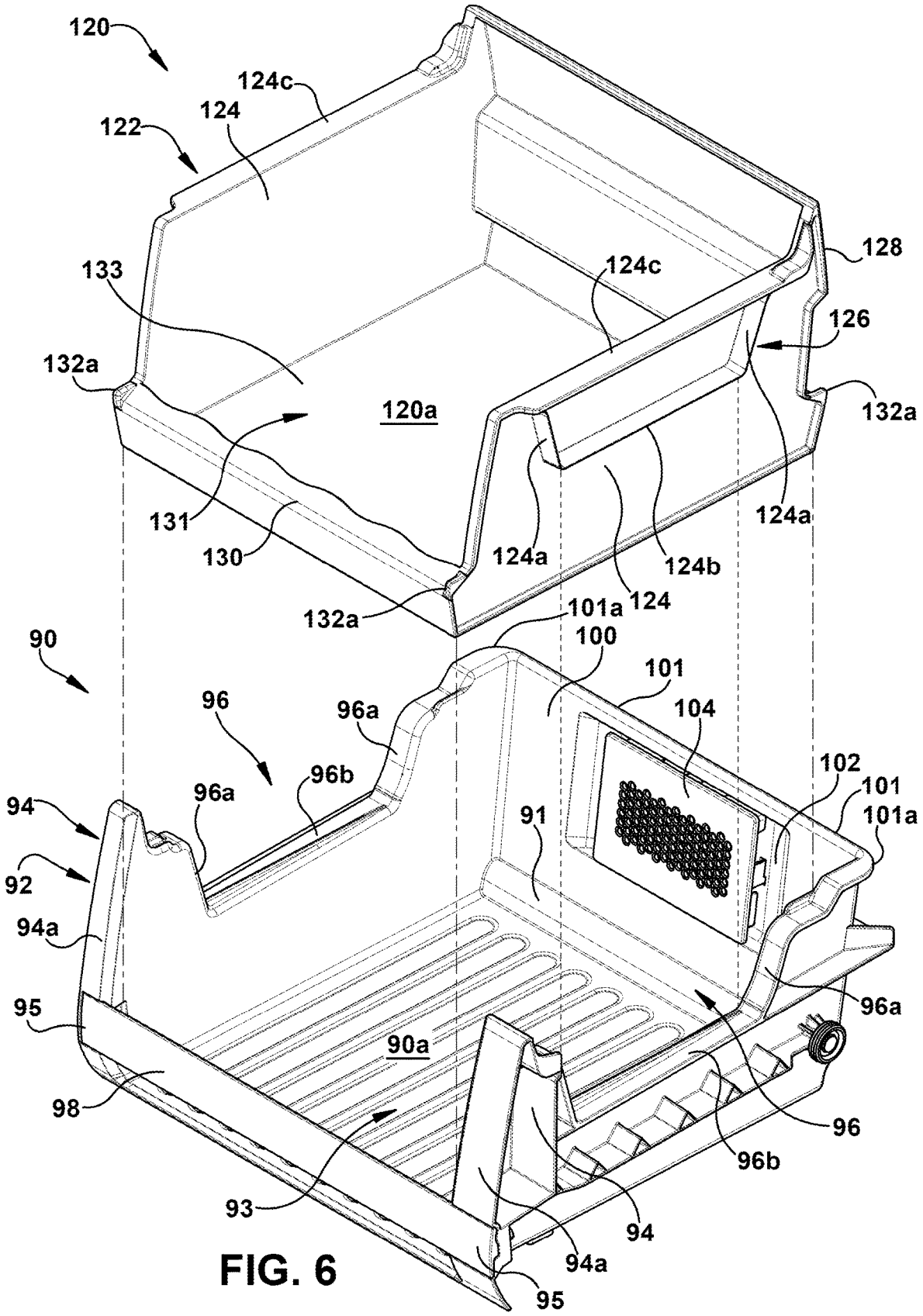
FIG. 6 is a perspective view of a carrier drawer shown in relation to a bin of the storage drawer assembly of FIG. 3 wherein the bin is positioned above the drawer in a second orientation.

Referring to FIGS. 5 and 6, an example of the single bin 120 according to the first embodiment is shown in the first orientation (FIG. 5) and the second orientation (FIG. 6) in relation to the carrier drawer 90. The bin 120 is preferably made of a plastic material of suitable strength (e.g., ABS, polypropylene, polystyrene, and the like). For ease of illustration, the bin 120 is presented as being made of an opaque plastic material. Preferably, the bin 120 is made of a transparent plastic material (See, e.g., FIG. 11B) so that the inner contents thereof may be visible to a user. In alternative embodiments, however, it is contemplated that the bin 120 may comprise a tinted or translucent plastic material.

Still referring to FIGS. 5 and 6, the bin 120 includes a bottom wall 120*a* and an upwardly extending wall 122 formed about at least a portion of the perimeter of the bottom wall 120*a*. In general, the upwardly extending wall 122 defines a storage space 133 for receiving and storing food items. In the illustrated example, the upwardly extending wall 122 includes a sealing wall 128 and opposing side walls 124. The sealing wall 128 encloses the storage space 133 of the bin 120 when the bin 120 is mounted or nested in the carrier drawer 90 in the first orientation (FIG. 5). In this manner, the sealing wall 128 also serves to at least partially define the enclosed storage space 315 (FIG. 9A) of the storage drawer assembly 60 when the bin 120 is mounted in the carrier drawer 90 in the first orientation, and when the carrier drawer 90 is retracted relative to the storage compartment, e.g., to function as a traditional crisper for storing fresh produce in a humidity controlled environment.

As shown in FIG. 6, the opposing side walls 124 of the bin 120 are spaced apart relative to each other to define an access opening 131 therebetween for enabling a user to reach into the storage space 133 of the bin 120 to place and/or remove food items therefrom when the bin 120 is mounted in the second orientation. An upwardly protruding lip 130 is formed about a periphery of the bottom wall 120*a* opposite the sealing wall 128 and spans the entire width of the access opening 131. In particular, the upwardly protruding lip 130 is configured to prevent food items (e.g., apples, oranges) stored in the bin 120 from falling or rolling out of the bin 120 when the bin 120 is mounted in the second orientation (FIG. 6). Preferably, the upwardly protruding lip 130 has a nominal height dimension such that the lip 130 does not obstruct a user's access to the bin 120 through the access opening 131 when the bin 120 is mounted in the second orientation. Optionally, the lip 130 can have a repeating curved perimeter (i.e., a "sine wave" shape) to provide a shape that readily accommodates bottles or cans stored inside the bin 120 and/or to provide a soft-touch edge surface for a user's hands.

Referring to FIGS. 5 and 6, a plurality of ribs or segments 124*a*, 124*b* may be formed on each side wall 124 of the bin 120 and protrude laterally therefrom to define a self-locating guide 126 that is configured to facilitate the placement of the bin 120 in the carrier drawer 90 in either the first (FIG. 5) or the second orientation (FIG. 6) thereof. In particular, each guide 126 may have a substantially U-shaped profile corresponding to the profile and dimensions of the contoured recess 96 formed in the respective side wall 94 of the carrier drawer 90. In the illustrated embodiment, each guide 126 is defined by two inclined, symmetrical ribs 124*a* and a substantially flat lower rib 124*b* that are shaped and dimensioned to respectively align and mate with inclined, symmetrical surfaces 96*a* and a substantially flat surface 96*b* defining the respective recess 96 formed in the carrier drawer 90. In this manner, the guides 126 of the bin 120 may be nested in the respective recesses 96 of the carrier drawer 90 in either the first (FIG. 5) or the second orientation (FIG. 6) of the bin 120 relative to the carrier drawer 90. In the illustrated embodiments, the guides 126 and the contoured recesses 96 are each substantially U-shaped. In other examples, it is contemplated that the guides 126 and the recesses 96 may have other complementary contours, e.g., a semi-circular contour.

As shown in FIGS. 5 and 6, outwardly extending flanges or tabs 124*c* may extend from upper, distal ends of the respective side walls 124 of the bin 120 to define gripping portions or handles that enable a user to grasp the bin 120, for example, when it is desired to remove the bin 120 for cleaning purposes, or when rearranging the orientation of the bin 120 (i.e., first or second) with respect to the carrier drawer 90. As described in detail above, each contoured recess 96 in the carrier drawer 90 also defines a pocket for enabling a user to place their hands on opposing sides of the bin 120 to grasp the bin 120, for example, by gripping the tabs 124*c* to remove or insert the bin 120 from or into the carrier drawer 90, respectively. In this manner, the tabs 124*c* of the bin 120 and the recesses 96 of the carrier drawer 90 enhance the ergonomic design of the storage drawer assembly 60 by making it easier to remove or insert the bin 120 from or into the carrier drawer 90, respectively.

As shown in FIG. 5, a substantially-rectangular-shaped pocket 128*a* may be formed along an entire longitudinal length of the sealing wall 128. In some examples, it is contemplated that the pocket 128*a* may be different in shape, e.g., semi-circular shaped contour, etc. Yet, in other examples, it is contemplated that the pocket 128*a* may extend along only a portion of the sealing wall 128. Together, the front handle 98 of the carrier drawer 90 and the pocket 128*a* collectively define a recessed handle for enabling a user to extend or retract the carrier drawer 90 relative to the storage compartment 50 (FIG. 3).

Figure 9A:
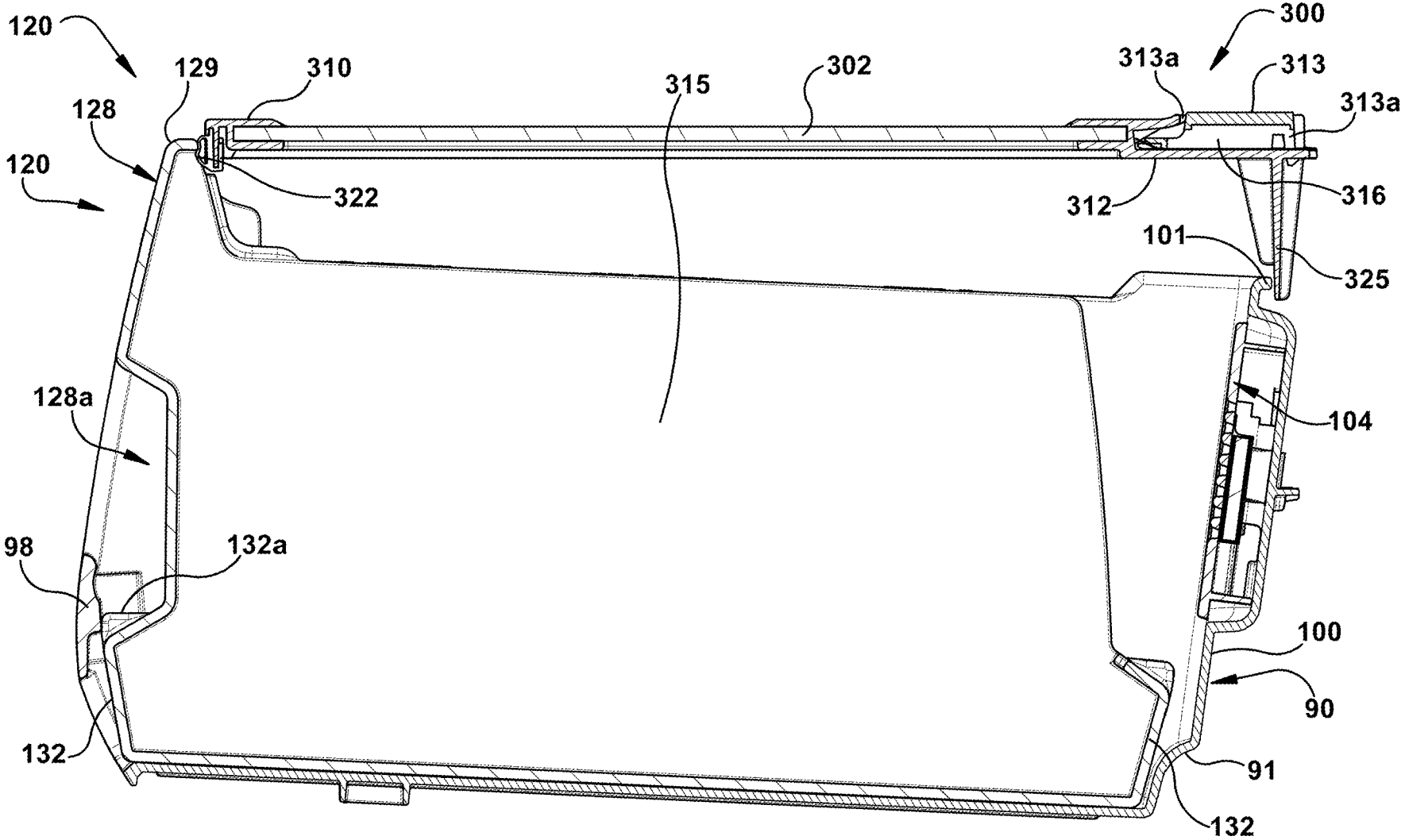
FIG. 9A is a cross-section view of the storage drawer assembly taken along line 9A-9A of FIG. 3.

Referring to FIG. 9A, an inwardly extending, curved lip 129 may extend from an upper, distal end of the sealing wall 128 and is configured to sealingly engage a gasket 322 disposed on the front of the lid 300 for enclosing the storage space 315 of the storage drawer assembly 60 when the bin 120 is mounted in the carrier drawer 90 in the first orientation, and when the carrier drawer 90 is in a fully retracted state.

Figure 9B:
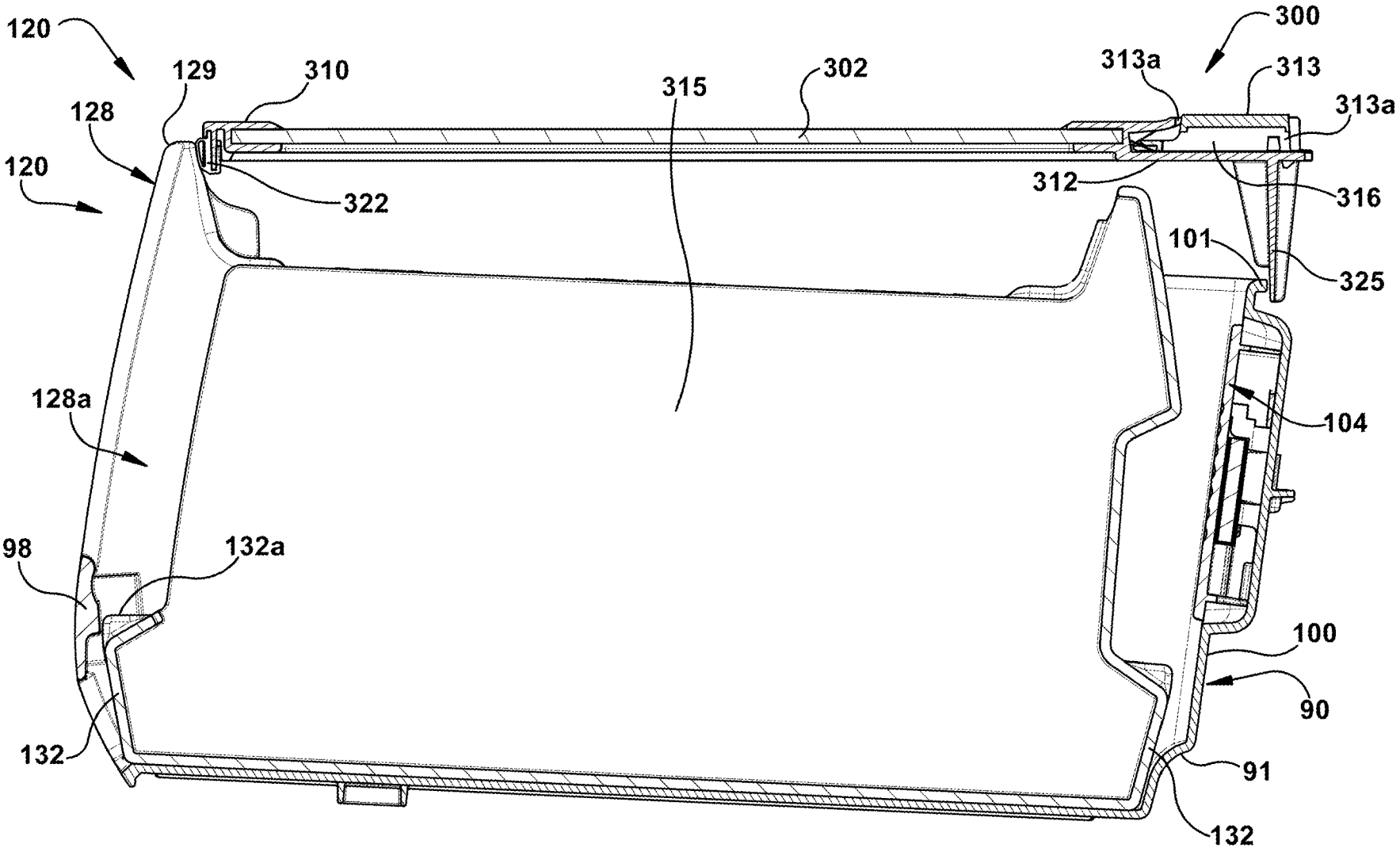
FIG. 9B is a cross-section view of the storage drawer assembly taken along line 9B-9B of FIG. 4.

As shown in FIGS. 9A and 9B, the bin 120 may include symmetrical, opposing ends 132 that are configured to abut the handle 98 and the curb 91 of the carrier drawer 90, respectively, to restrain the bin 120 when it is mounted in the carrier drawer 90 in either the first (FIG. 9A) or the second orientation (FIG. 9B). Preferably, the ends 132 have a similar or identical shape, size, and angle that corresponds to the abutment surfaces of the handle 98 and the curb 91. In some examples, each opposing end 132 may define an outwardly protruding fin 132*a* that is dimensioned to abut the handle 98 when the bin 120 is mounted in either the first or second orientation.

Figure 7:
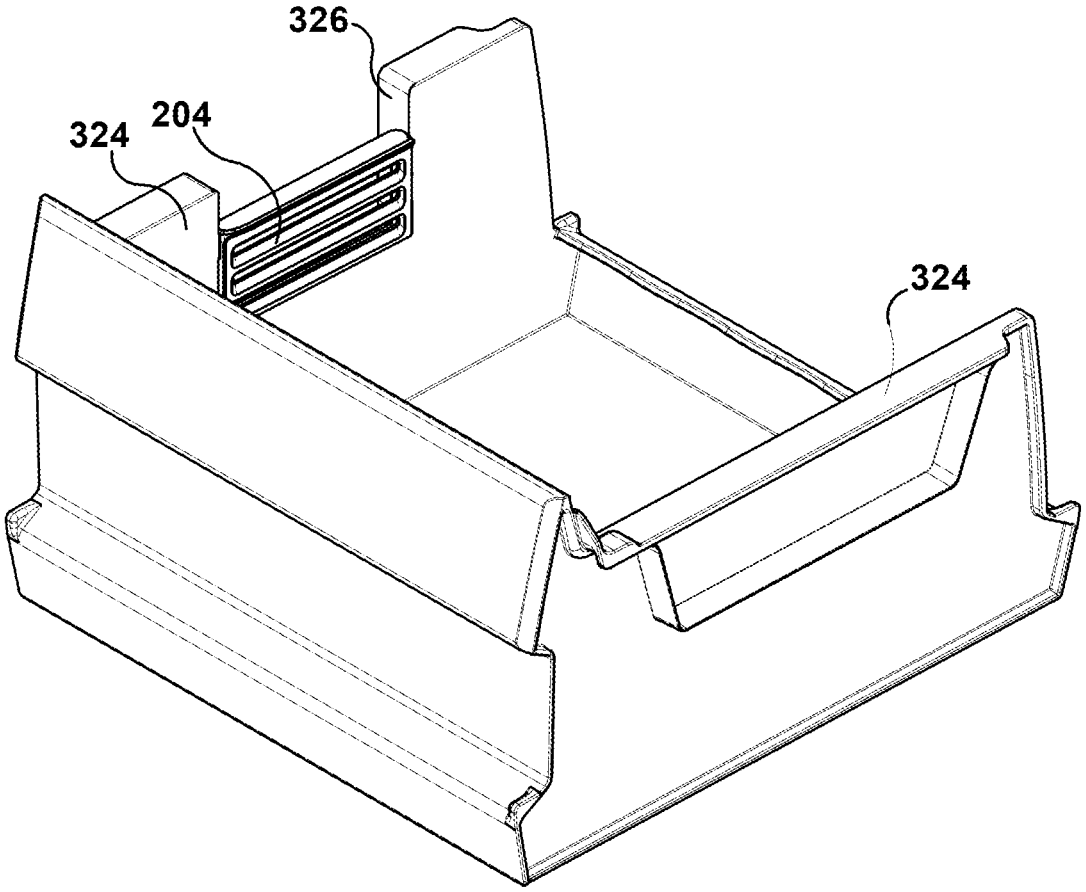
FIG. 7 is a perspective view of a bin of a storage drawer assembly according to a second embodiment.

Referring now to FIG. 7, an example of a bin 320 according to a second embodiment is shown. The bin 320 of the second embodiment is substantially the same as the bins 120, 220 of the first embodiment. Therefore, a detailed description therefor is omitted, except for the differences noted below. In the shown example, a recess 326 is formed in a side wall 324 of the bin 320 and is shaped and dimensioned to removably receive and retain therein a filter cartridge 204. That is, and in distinction to the first embodiment, the filter cartridge 204 of the second embodiment is secured to a single side wall 324 of the bin 320, rather than on a wall 100 (FIG. 5) of the carrier drawer 90. As noted above, the filter cartridge 204 is configured to treat the environment inside of the enclosed storage space 315 of the storage drawer assembly 60 when the bin 320 is disposed in the first orientation (as shown), and when the carrier drawer 90 is in a fully retracted state relative to the storage compartment. In various non-limiting examples, the cartridge 204 could include any or all of an ethylene absorber cartridge; an air filter cartridge; a deodorizer cartridge; an antioxidant cartridge; a humidity control cartridge; etc.

Figure 8A:
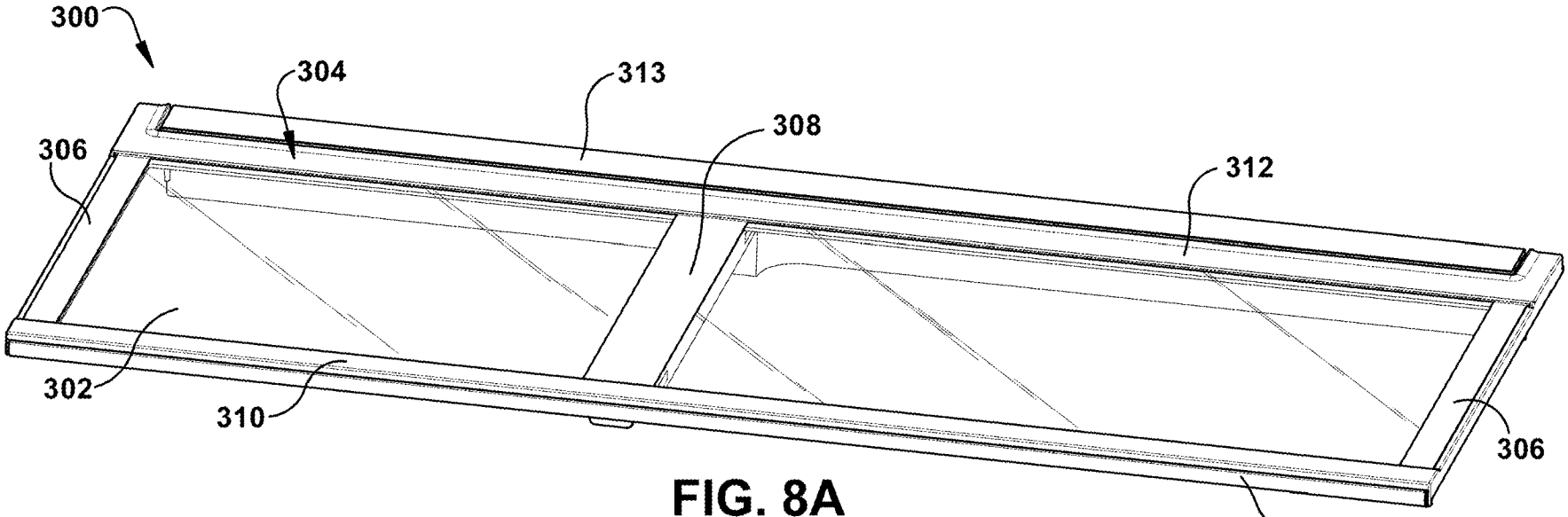
FIG. 8A is a top perspective view of a lid of the storage drawer assembly of FIG. 3.

Turning now to FIG. 8A, an example of the lid 300 is shown in isolation. In general, the lid 300 comprises a substantially planar panel 302 that is supported by a frame 304. In some examples, the panel 302 may be a glass panel, although other rigid materials are also contemplated, such as plastic. Preferably, the panel 302 is transparent so that the user can see downwardly into the storage drawer assembly 60 (FIG. 3), and more preferably downwardly into the entire extent of the bins 120, 220 (FIG. 3). However, it is also contemplated that the panel 302 may be partially or completely made of an opaque, tinted, or translucent material. In the illustrated embodiment, the frame 304 embodies a unitary structure comprising opposing side members 306 and a cross member 308 that are connected by a front trim member 310 and a rear trim member 312. Alternatively, it is contemplated that the respective members 306, 308, 310, and 312 may be formed separately and coupled together utilizing fasteners (e.g., snaps, clips, screws, nuts, bolts, etc.) to assemble the frame 304. Moreover, the frame 304 is preferably made from a plastic material of suitable strength (e.g., ABS, polypropylene, polystyrene, and the like).

The front trim member 310 comprises an elongated body that serves to retain a front longitudinal edge (not shown) of the panel 302. Referring to FIG. 9A, a front gasket 322 may be attached to the front trim member 310 for sealing the enclosed storage space 315 of the storage drawer assembly 60 when the bin 120 is mounted in the first orientation, and when the carrier drawer 90 is in a fully retracted state relative to the storage compartment 50. In particular, the front gasket 322 is adapted to sealingly engage an upper distal end or lip 129 of the bin 120 when the carrier drawer 90 is in a fully retracted state.

In addition or alternatively, it is contemplated that the front gasket 322 may be sized and dimensioned such that it abuts a rear portion of the sealing wall 128 along substantially the entire length thereof, for example, in such embodiments wherein the sealing wall 128 of the bin 120 does not include an inwardly-facing lip 129 formed on an upper, distal end thereof.

Referring back to FIG. 8A, the rear trim member 312 of the lid 300 embodies an elongated body that is configured to retain a rear longitudinal edge (not shown) of the panel 302 thereon. In the shown example, a removable cover 313 is removably attached to the rear trim member 312 of the lid 300.

Referring to FIG. 9A, in some embodiments, the cover 313 and the rear trim member 312 may define a longitudinal void 316 therebetween for accommodating a humidity membrane (not shown) that is removably placed therein, for example, in such embodiments wherein the storage drawer assembly 60 is configured to function as a crisper for storing fresh produce therein. In general, the humidity membrane comprises a paper-based, replaceable item that has a high moisture vapor transmission rate (MVTR) and is preferably hydrophobic (e.g., Tyvek material). In this manner, the humidity membrane facilitates the removal of moisture and gases from the storage space 315 of the storage drawer assembly 60 to the storage compartment 50 when the bin 120 is mounted in the first orientation, and when the carrier drawer 90 is in a fully retracted state relative to the lid 300. In such embodiments, one or more openings 312*a* (FIG. 8B) may be formed into a lower surface or grid of the rear trim member 312 for enabling moisture and gases emanating from the storage space 315 to fluidly communicate with the humidity membrane. In a similar manner, and referring to FIG. 9A, one or more openings 313*a* may be formed in the cover 313 to enable moisture and gases passing through the void 316 (defined by the cover 313 and the rear trim member 312) to escape the storage drawer assembly 60. Yet, it should be appreciated that in other embodiments, the rear trim member 312 may comprise a solid component (formed without openings or a longitudinal void), for example, in such embodiments wherein the storage drawer assembly 60 is configured to operate as a chiller compartment for storing fresh meats or raw fish therein at customizable temperature setting that is different from the temperature setting of the general storage compartment 50.

Figure 8B:
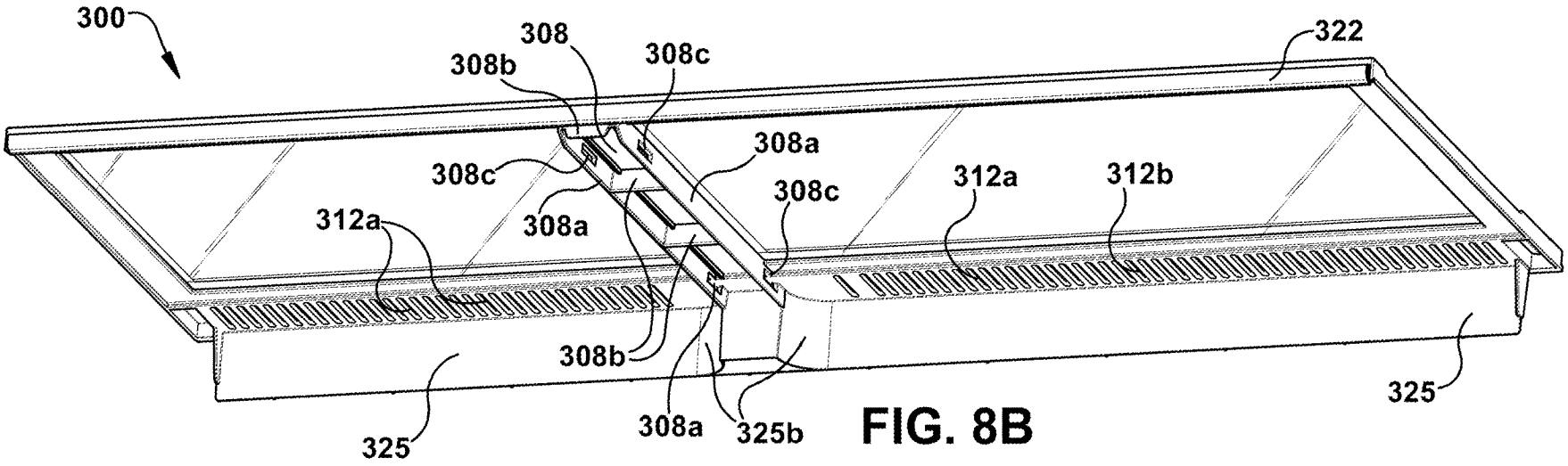
FIG. 8B is a bottom perspective view of the lid of FIG. 8A.

Referring to FIGS. 8B and 9A, a downwardly protruding wall 325 may extend from a lower surface of the rear trim member 312 and extend an entire longitudinal length thereof for enclosing the storage space 315 (FIG. 9A) of the storage drawer assembly 60. In particular, the downwardly protruding wall 325 is positioned adjacent to an outwardly extending lip 101 formed on the rear wall 100 of the carrier drawer 90 to close a rear portion of the storage space 315 of the storage drawer assembly 60. In this manner, the downwardly protruding wall 325 and the outwardly extending lip 101 cooperate to inhibit the passage of air between the storage space 315 of the storage drawer assembly 60 and an external environment. In some examples, it is contemplated that fully retracting the carrier drawer 90 may cause the outwardly extending lip 101 of the drawer 90 to press against the downwardly protruding wall 325 of the lid 300, thereby sealingly enclosing the storage space 315 of the storage drawer assembly 60, for example, in such embodiments wherein a rear gasket (not shown) is disposed on a lower, distal end of the downwardly protruding wall 325. However, in other embodiments there may be a small gap separating the downwardly protruding wall 325 from the outwardly extending lip 101 of the drawer 90 which inhibits airflow into the storage space 315.

Referring to FIG. 8B, a bottom perspective view of the lid 300 is shown in isolation. In the shown example, the cross member 308 of the frame 304 includes longitudinal walls 308*a* and a front wall 308*b* extending from a lower surface thereof that together with the downwardly protruding wall 325 define a rectangular shaped enclosure that is sized and dimensioned to cover an upper, exposed end 400*a* (FIG. 10) of a center stanchion or center support 400 (FIG. 10) that is attached to a bottom wall 50*c* of the storage compartment 50, as discussed in detail below. In particular, the cross member 308 is configured to snap onto the center support 400 (FIG. 10) for fixing the lid 300 to the storage compartment 50. As shown in FIG. 8B, the longitudinal walls 308*a* of the cross member 308 each define a plurality of slots 308*c* extending therethrough that are respectively configured to accommodate therein and engage with a plurality of snaps 402 (FIG. 10) formed on the upper end 400*a* of the center support 400. In this manner, the slots 308*c* in the cross member 308 and the snaps 402 of the center support enable the lid 300 to be snapped onto the center support 400 for securing the lid 300 to the storage compartment 50. As shown in FIG. 8B, a plurality of lateral ribs 308*d* may extend between the longitudinal walls 308*a* of the cross member 308 and are spaced and dimensioned to respectively align with cut-outs 404 (FIG. 10) formed in the upper end 400*a* of the central support 400. In this manner the ribs 308*d* embody locating features that define a mounting position of the lid 300 relative to the center support 400 (and the storage compartment 50) such that the lid 300 may snap onto the center support 400 (via the inter-engagement of the snaps 402 and the slots 308*c*) only when the ribs 308*d* are appropriately aligned with the cut-outs 404, respectively. That is, the lid 300 may be pressed downwards to snap onto the center support 400 when the ribs 308*d* and the cutouts 404 are appropriately aligned.

Still referring to FIG. 8B, the downwardly protruding wall 325 of the lid 300 is curved in the vicinity of the central support 400. In particular, the downwardly protruding wall 325 includes two curved portions 325*b* having a profile that is complementary to rounded portions 101*a* (FIG. 5) of the lip 101 formed on the carrier drawer 90. In this manner, the downwardly protruding wall 325 is shaped and dimensioned to cooperate with the carrier drawer 90 to inhibit the passage of air between the storage space 315 of the storage drawer assembly 60 and the external environment. In such embodiments, if an optional gasket (not shown) is disposed on the downwardly protruding wall 325, it is contemplated that the gasket may likewise comprise curved portions that sealingly engage the rounded portions 101*a* of the carrier drawer 90 to seal the storage space 315 of the storage drawer assembly 60 from the external environment.

Figure 10:
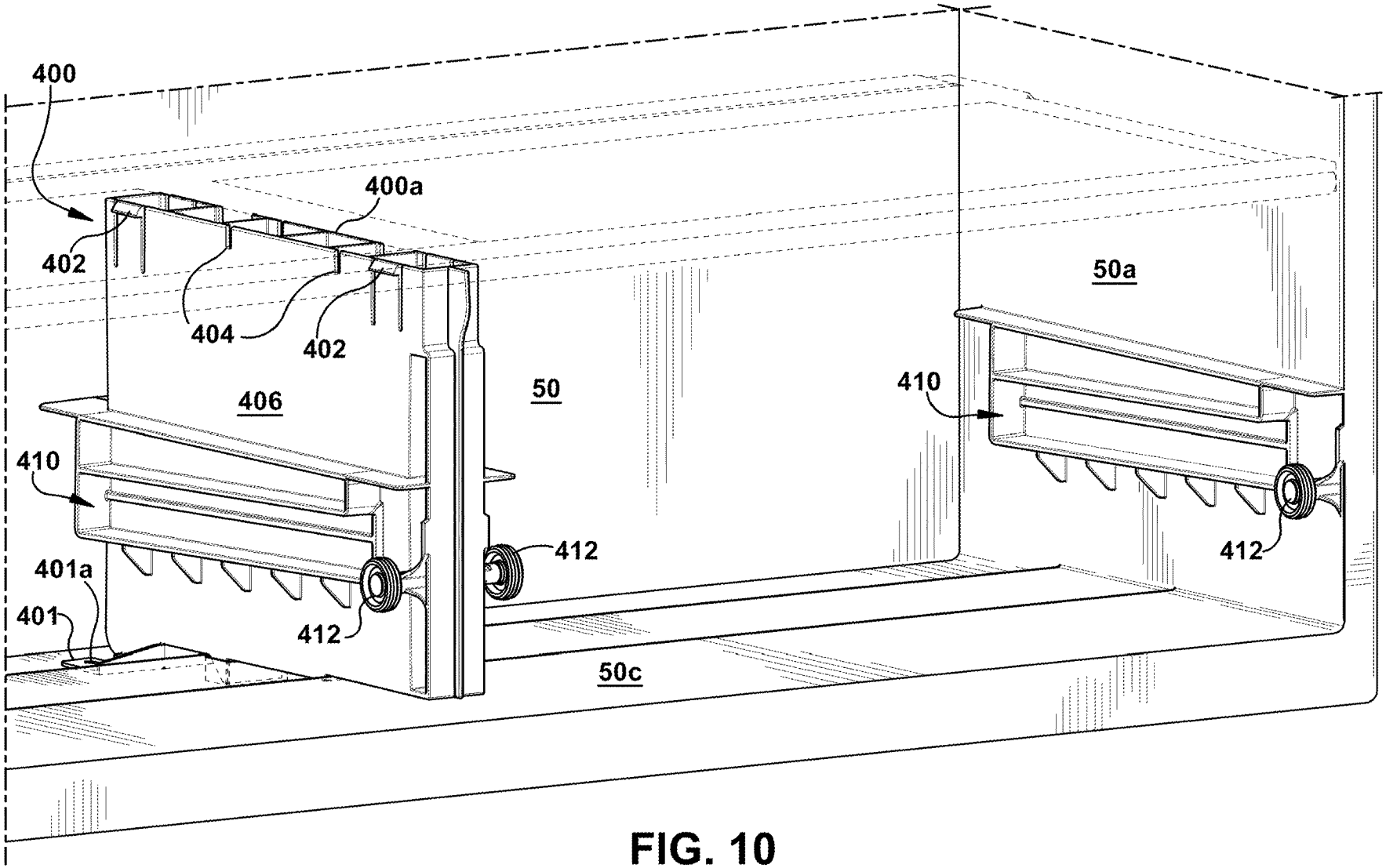
FIG. 10 is an enlarged, closeup perspective view of a central support for the storage drawer assembly of FIG. 3 shown in relation to the storage compartment according to the first embodiment.

Referring now to FIG. 10, an example of the central support 400 is shown in relation to the storage compartment 50 in a state wherein the carrier drawers 90, 190 and the bins 120, 220 are removed for clarity. Generally, the center support 400 represents a multi-purposed structure that is configured to secure the lid 300 to the storage compartment 50, while helping confine the respective, enclosed storage spaces (See, e.g., 315 in FIG. 9A) of the storage drawer assembly 60 located on opposing sides thereof.

In the illustrated embodiment, the center support 400 includes rear facing tabs 401 extending therefrom (one being hidden by the center support) defining holes 401*a* extending therethrough, respectively, that are configured to accommodate anchor nuts (not shown) for securing the center support 400 to a bottom wall 50*c* of the storage compartment 50.

Moreover, the center support 400 also serves to support inwardly facing sides of the respective carrier drawers 90, 190, while providing a reduced friction interface between the drawers 90, 190 and the center support 400 so that the drawers 90, 190 may be extended and retracted relative to the storage compartment 50. More specifically, the center support 400 includes side walls 406, each comprising a recessed track 410 formed therein that is configured to accommodate a roller 110 (FIG. 5) attached to an inwardly-facing side wall 94 of the respective carrier drawer 90. In this manner, the rollers 110 attached to the drawers 90, 190 may roll along or within the recessed tracks 410 of the center support 400 to facilitate the extension and retraction of the drawers 90, 190 relative to the storage compartment 50.

As shown in FIG. 10, stationary rollers 412 may be attached to the respective side walls 406 of the center support 400 at a front portion thereof. In particular, each stationary roller 412 is configured to roll along the lower surface 112*a* (FIG. 5) of the guide 112 formed on the respective side wall 94 of a corresponding, carrier drawer 90. In the illustrated embodiment, each side wall 50*a* of the storage compartment 50 (FIG. 3) also comprises a recessed track 410 and a stationary roller 412 for supporting an opposite side wall of a respective carrier drawer (e.g., 190 in FIG. 3), i.e., opposite the side wall of the respective drawer that is adjacent to the center support 400. In this manner, it should be understood that each side wall 50*a* of the storage compartment 50 may also be configured to provide a reduced friction interface for an opposite side of each carrier drawer, thereby enabling the carrier drawers 90, 190 to be extended and retracted relative to the storage compartment 50.

Figure 11A:
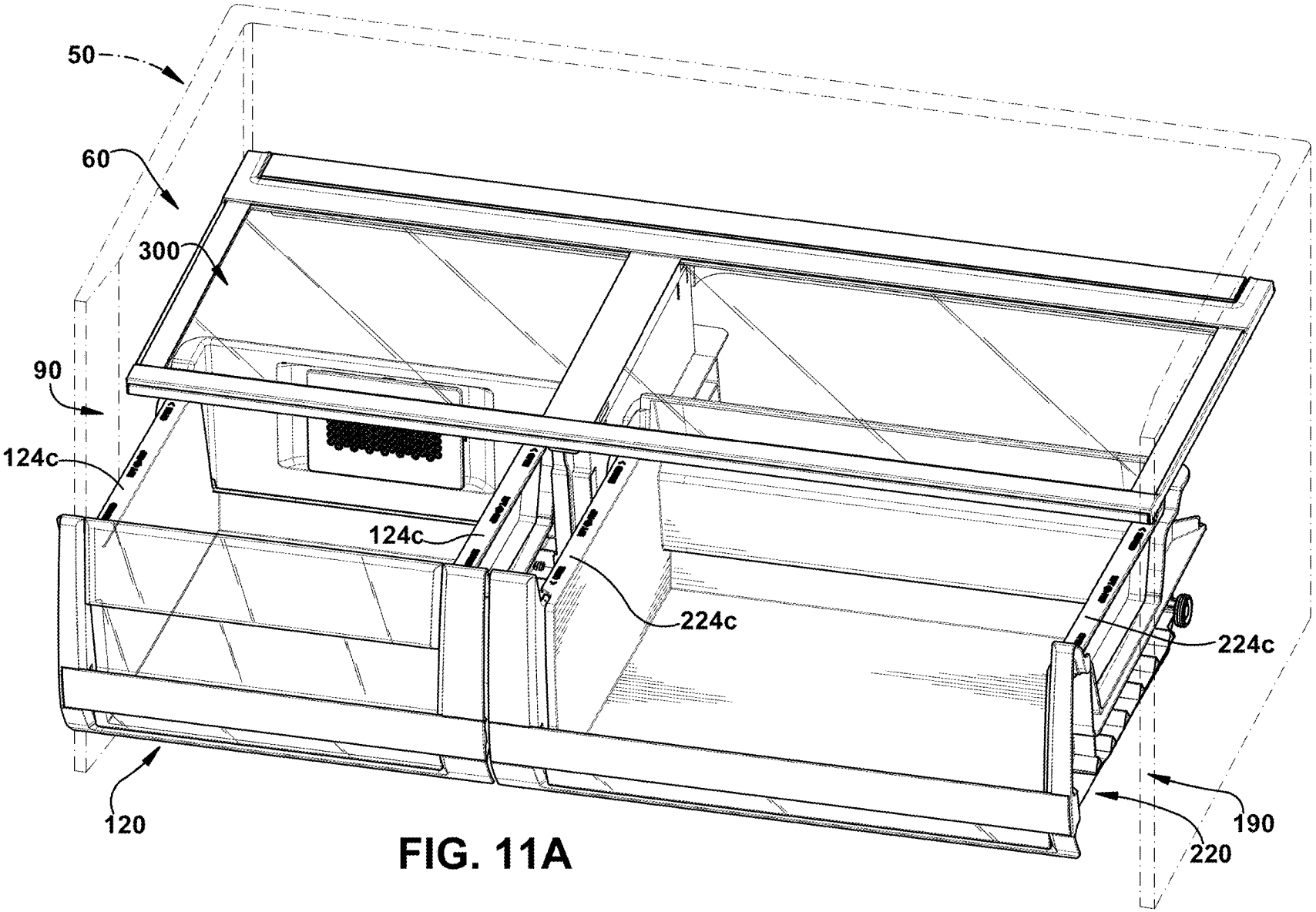
FIG. 11A is an enlarged perspective view of the storage compartment of FIG. 3 wherein carrier drawers of the storage drawer assembly are shown in an extended state.
Figure 11B:
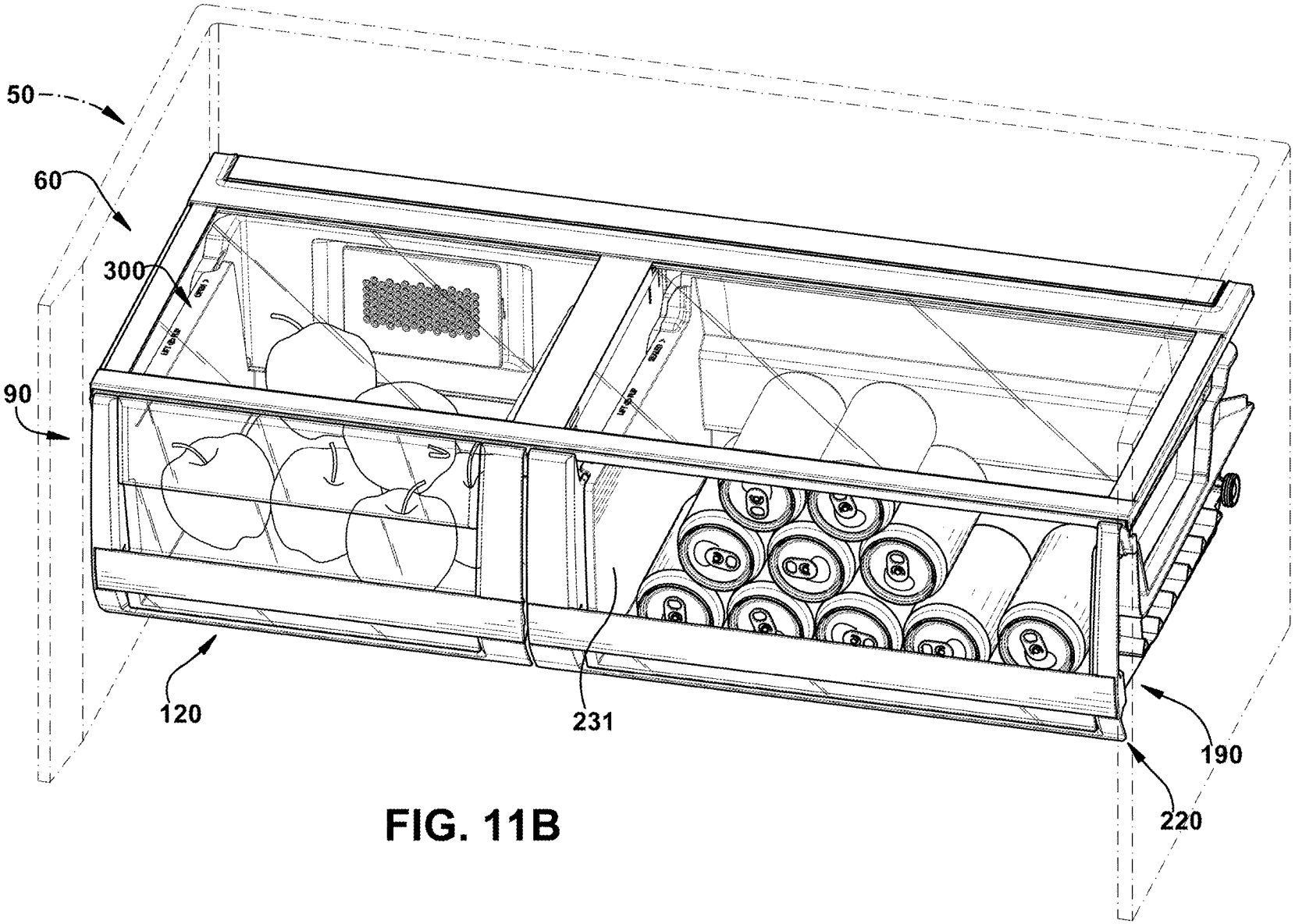
FIG. 11B is an enlarged perspective view of the storage compartment of FIG. 3 wherein bins of the storage drawer assembly are shown storing various food items therein.

Turning now to FIGS. 11A and 11B, the storage drawer assembly 60 will be described with respect to the utilization of the same. The following description is based on an example use wherein the bin 120 of the first carrier drawer 90 is in the first orientation, and the and the bin 220 of the second carrier drawer 190 is in the second orientation. However, it should be appreciated that the following description equally applies to other scenarios, for example, when the bin 120 of the first carrier drawer 90 is in the second orientation, and when the bin 220 of the second carrier drawer 190 is in the first orientation, or wherein both bins 120, 220 are in the same orientation with respect to each other.

As shown in FIG. 11A, the bins 120, 220 may be inserted or removed from the storage drawer assembly 60 by pulling the carrier drawers 90, 190 to an extended state via the respective handles 98, 198 thereof. In this way, a user may remove the bins 120, 220 from the carrier drawers 90, 190 by grasping the tabs 124*c*, 224*c* formed on the respective bins 120, 220 to remove or re-insert the bins 120, 220 from or into the carrier drawers 90, 190, respectively.

In the illustrated embodiment, the first bin 120 is inserted into its respective carrier drawer 90 in the first orientation, for example, so that fresh produce (e.g., apples) may be stored therein. In this manner, the carrier drawer 90 may be retracted (FIG. 11B) relative to the storage compartment 50 for closing the storage space 315 (FIG. 9A) therein from the ambient air of the storage compartment 50. More specifically, and as shown in FIG. 9A, the front gasket 322 of the lid 300 will sealingly engage the sealing wall 128 of the bin 120, and the lip 101 formed on the rear wall 100 of the carrier drawer 90 will be positioned adjacent to the downwardly protruding wall 325 of the lid 300. Additionally, the storage space 315 will be closed by a respective compartment wall 50*a* (See, e.g., FIG. 3) and the center support 400 (FIG. 10) located on an opposing side thereof. In this manner, and in such embodiments wherein the lid 300 comprises a humidity membrane, moisture or gases (e.g., condensation, ethylene gas) emitted from the food items (e.g., fruits) placed in the bin 120 will be forced to exit the enclosed storage space 315 through the openings 312*a* (FIG. 8B) formed in the lower surface of the lid 300. Accordingly, moisture or gases exiting the storage space 315 will be forced to fluidly communicate with the humidity membrane (not shown) disposed in the void 316 of the lid 300 before exiting the storage drawer assembly 60 through the openings 313*a* (FIG. 9A) formed in the cover 313 of the lid 300. In this respect, the humidity membrane disposed underneath the cover 313 of the lid 300 helps facilitate the removal of moisture and/or gases from the storage space 315 of the storage drawer assembly 60 to preserve the edible life and freshness of the produce that is stored therein.

Additionally, and in such examples wherein the cartridge 104 (FIG. 11B) disposed on the rear wall of the carrier drawer 90 is an antioxidant filter cartridge, the cartridge 104 will absorb residual ethylene gas in the enclosed storage space 315 to further enhance the freshness of the produce stored therein.

Referring to FIG. 11B, the second bin 220 may be inserted in the respective carrier drawer 190 in a second orientation, for example, to provide a general storage space for a variety of other food items, e.g., beverage cans as shown. Distinctively, a user desiring to remove food items from the second bin 220 may readily reach into the storage space defined through an open front access opening 231 of the bin 220, without having to withdraw the corresponding carrier drawer 190 to an extended position. Additionally, items stored in the bin 220 with the front access opening 231 can be relatively more exposed to the cold air flowing inside the refrigerator compartment, which can cause items stored inside the bin 220 to cool at a relatively faster rate as compared with items located in a closed bin. This aspect of the present disclosure is particularly beneficial for improving the accessibility of food items stored in the bin 220. Moreover, since each bin 120, 220 may be reversibly mounted into its respective carrier drawer 90, 190, it is possible to provide a versatile storage compartment design that is adaptable for a consumer's changing storage needs.

Figure 12:
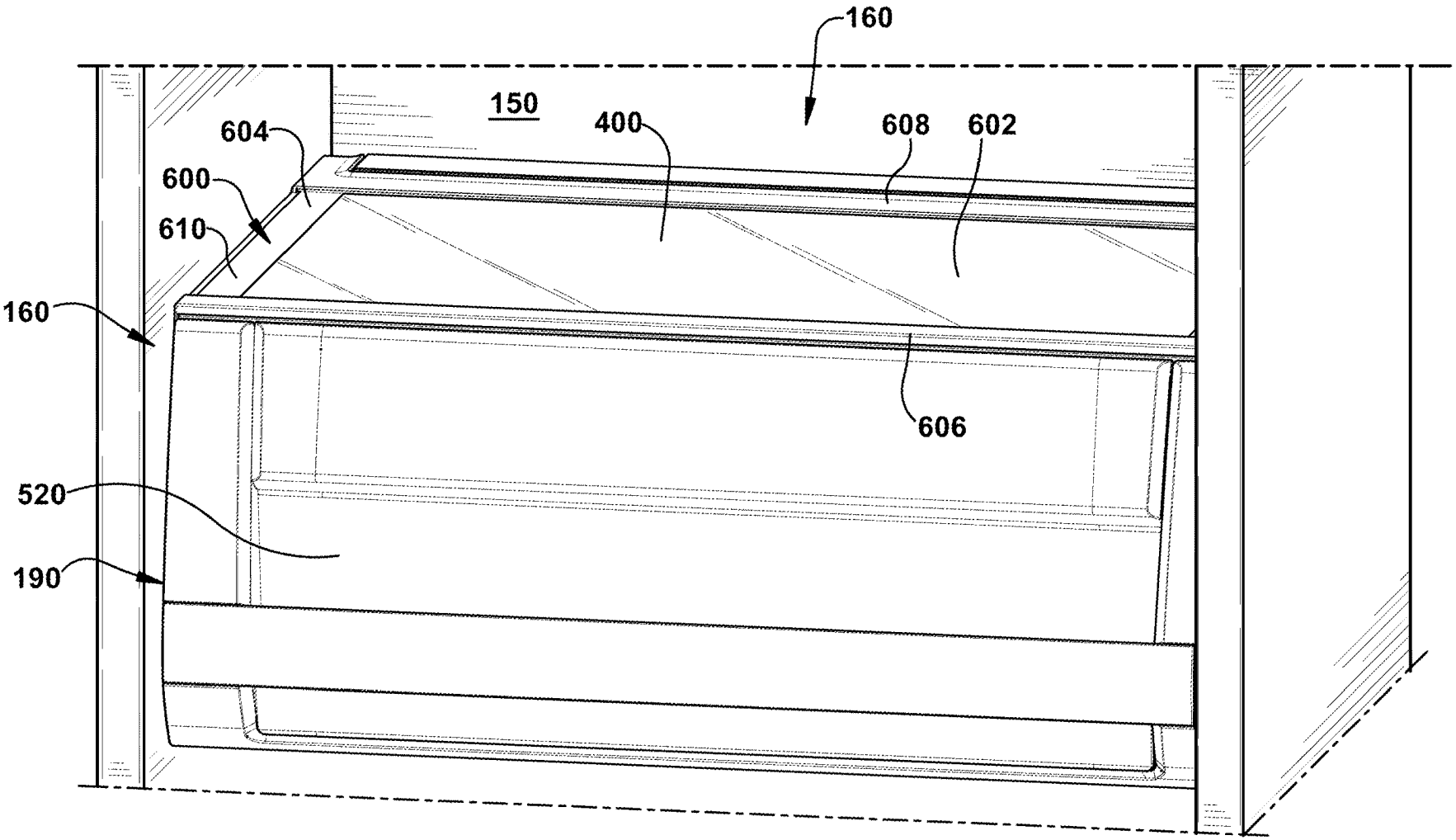
FIG. 12 is an enlarged perspective view of a fresh food storage compartment according to another embodiment including a second example of a storage drawer assembly as disclosed herein.

Turning now to FIG. 12, another exemplary embodiment of a storage drawer assembly 160 is shown. In distinction to the previous embodiments, the storage drawer assembly 160 includes a single bin 520 that may be reversibly mounted in a single carrier drawer 490 that spans the entire width of the storage compartment 150. A lid 600 is arranged on the storage drawer assembly 160 for enclosing and/or sealing the storage space defined therein when the bin 520 is in the first orientation relative to the carrier drawer 490. The bin 520, the carrier drawer 490, and the lid 600 includes features that are substantially similar to the bins, drawers, and lids described herein. Therefore, a detailed description therefor is omitted, except for the differences noted below.

The lid 600 includes a planar panel 602 supported by a frame 604 comprising a front trim member 606 and a rear trim member 608 that are connected by opposing side members 610. In distinction to the previous embodiment, the lid 600 does not include a cross member, since opposing sides of the carrier drawer 490 of the present embodiment are supported by opposing side walls of the refrigerator storage compartment.

The invention has been described with reference to the example embodiments described above. Modifications and alterations will occur to others upon a reading and understanding of this specification. Moreover, the storage drawer assemblies described herein may be adapted for placement in different refrigerator configurations (e.g., French-door, Top mount, Bottom mount). Example embodiments incorporating one or more aspects of the invention are intended to include all such modifications and alterations insofar as they come within the scope of the appended claims and their equivalents.

What is claimed is:

1. A storage drawer assembly comprising:

a carrier drawer that is configured to be extended or retracted relative to a storage compartment; and a bin reversibly mounted in the carrier drawer, wherein the bin defines a storage space for receiving food items and is configured to be mounted in the carrier drawer in a first orientation relative to the carrier drawer, and a second orientation relative to the carrier drawer, wherein the bin comprises a first upwardly extending wall configured to at least partially enclose the storage space in the first orientation, and a second upwardly extending wall opposing the first upwardly extending wall and defining a front access opening to grant access to the storage space in the second orientation.

2. The storage drawer assembly according to claim 1, wherein the storage drawer assembly further comprises:

a lid that is configured to enclose the storage space when the bin is in the first orientation and when the carrier drawer is retracted relative to the storage compartment.

3. The storage drawer assembly according to claim 2, wherein the lid comprises a front trim member and a rear trim member, wherein a gasket is disposed on the front trim member and a downwardly protruding wall is disposed on the rear trim member, wherein the gasket is configured to engage the first upwardly extending wall of the bin, and the downwardly protruding wall is configured to cooperate with the carrier drawer to create an enclosed storage space.

4. The storage drawer assembly according to claim 3, wherein the carrier drawer further comprises an upwardly extending wall, and wherein a removable cartridge is attached to the upwardly extending wall for treating an environment inside of the enclosed storage space.

5. The storage drawer assembly according to claim 3, wherein a cover is removably attached to the rear trim member to define a void therebetween, and wherein a humidity membrane is placed in the void to enable moisture and gases to exit the enclosed storage space when the carrier drawer is in a retracted position.

6. The storage drawer assembly according to claim 1, wherein the bin further comprises:

a bottom wall; and a lip formed about a portion of a periphery of the bottom wall, wherein the lip is configured to restrain food items in the storage space when the bin is mounted in the second orientation.

7. The storage drawer assembly according to claim 1, wherein the bin further comprises:

a bottom wall;

wherein the first upwardly extending wall is formed about a portion of a periphery of the bottom wall.

8. The storage drawer assembly according to claim 7, wherein the bin comprises opposing side walls spaced apart and connected by the first upwardly extending wall.

9. The storage drawer assembly according to claim 7, wherein the bin comprises opposing side walls, and wherein each side wall includes an outwardly projecting tab that is configured to be gripped by a user to remove the bin from the carrier drawer.

10. The storage drawer assembly according to claim 7, wherein the bin comprises a side wall, wherein a guide is formed on the side wall of the bin, the guide being shaped and dimensioned to be received by a recess formed in the carrier drawer to facilitate placing the bin in the carrier drawer in either the first orientation or the second orientation.

11. The storage drawer assembly according to claim 10, wherein the guide comprises a rib having a symmetrical profile that corresponds to a profile of the recess such that the rib may be nested in the recess in either the first orientation or the second orientation to facilitate placing the bin in the carrier drawer.

12. A crisper assembly comprising:

a plurality of carrier drawers, wherein each carrier drawer is configured to be independently extended or retracted relative to a storage compartment; and a plurality of bins each reversibly mounted in a selected one of the carrier drawers, respectively, wherein each bin defines a storage space of the crisper assembly, and wherein each bin is configured to be mounted in a respective carrier drawer in either a first orientation relative to the carrier drawer, and a second orientation relative to the carrier drawer, wherein each bin comprises a first upwardly extending wall configured to at least partially enclose the respective storage space in the first orientation, and a second upwardly extending wall opposing the first upwardly extending wall, said second upwardly extending wall defining a front access opening to grant access to the respective storage space in the second orientation; and a lid disposed above the carrier drawers and configured to cover the storage spaces of the crisper assembly when the bins are mounted in the first orientation.

13. The crisper assembly according to claim 12, the crisper assembly further comprising a central support that is configured to secure the lid to the storage compartment.

14. The crisper assembly according to claim 13, wherein the central support comprises a snap formed on an upper end thereof that is configured to engage a slot formed in the lid for securing the lid to the storage compartment.

15. The crisper assembly according to claim 13, wherein the central support is configured to at least partially enclose the storage spaces of the crisper assembly.

16. The crisper assembly according to claim 13, wherein the central support is configured to support a respective side of each carrier drawer, and wherein the central support defines recessed tracks on opposing sides thereof that are configured to receive rollers attached to the respective sides of the carrier drawers such that the carrier drawers may be extended and retracted relative to the storage compartment.

17. The crisper assembly according to claim 12, wherein the lid comprises:

a frame and a planar panel, wherein the frame comprises a rear grid defining a plurality of air-passage openings therein; and a removable cover disposed on the rear grid, whereby when the cover is disposed on the rear grid, it defines a void therebetween for accommodating a humidity membrane.

18. The crisper assembly according to claim 12, wherein the lid further comprises a front trim member and a rear trim member, wherein a gasket is disposed on the front trim member and a downwardly protruding wall is disposed on the rear trim member, wherein the gasket is configured to sealingly engage the first upwardly extending wall of each bin, and wherein the downwardly protruding wall is configured to cooperate with a wall of each carrier drawer to close the storage spaces of the crisper assembly when the carrier drawers are retracted relative to the storage compartment.

19. The crisper assembly according to claim 12, wherein a cartridge is disposed on a wall of each carrier drawer and is configured to treat an environment inside of the crisper assembly when the bins are in the first orientation and when the carrier drawers are retracted relative to the storage compartment.

20. A refrigerator appliance, comprising:

a refrigerator storage compartment;

a plurality of carrier drawers, wherein each carrier drawer is configured to be independently extended or retracted relative to the storage compartment;

a plurality of bins each reversibly mounted in a selected one of the respective drawers, wherein each bin defines a storage space of the storage compartment, and wherein each bin is configured to be mounted in the respective carrier drawer in either a first orientation ef-relative to the carrier drawer, and a second orientation relative to the carrier drawer, and wherein each bin comprises a first upwardly extending wall configured to at least partially enclose the respective storage space in the first orientation, and a second upwardly extending wall opposing the first upwardly extending wall and configured to grant access to the respective storage space in the second orientation;

a lid disposed above the carrier drawers, wherein the lid comprises a gasket and a downwardly protruding wall; and a central support that is configured to secure the lid to the storage compartment, wherein the gasket is configured to sealingly engage the bins when the bins are in the first orientation, and wherein the downwardly protruding wall is configured to cooperate with the carrier drawers when the carrier drawers are retracted relative to the storage compartment for closing the respective storage spaces of the storage compartment.

21. The storage drawer assembly according to claim 1, wherein the storage drawer assembly further comprises:

a lid that is configured to enclose the storage space when the bin is in the first orientation and when the carrier drawer is retracted relative to the storage compartment, wherein the first upwardly extending wall is configured to engage the lid in the first orientation to define a sealed storage environment.

* * * * *